US007300053B2

(12) United States Patent
Asano

(10) Patent No.: US 7,300,053 B2
(45) Date of Patent: Nov. 27, 2007

(54) SHEET STORAGE DEVICE FOR IMAGE FORMING APPARATUS

(75) Inventor: Yukihiro Asano, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 331 days.

(21) Appl. No.: 10/867,734

(22) Filed: Jun. 16, 2004

(65) Prior Publication Data

US 2005/0133987 A1 Jun. 23, 2005

(30) Foreign Application Priority Data

Dec. 5, 2003 (JP) ..... 2003-407322

(51) Int. Cl.
*B65H 31/20* (2006.01)

(52) U.S. Cl. ..... 271/224; 271/220

(58) Field of Classification Search ..... 271/220, 271/223, 224

See application file for complete search history.

(56) References Cited

U.S. PATENT DOCUMENTS 470,898 A * 3/1892 Reiffel ..... 271/224
3,907,128 A * 9/1975 Cathers ..... 414/788.9
5,931,461 A * 8/1999 Xu ..... 271/224
6,494,450 B2 * 12/2002 Tsurumaki ..... 271/224

FOREIGN PATENT DOCUMENTS

JP 08-020468 1/1996
JP 11-217151 8/1999

* cited by examiner

*Primary Examiner*—Patrick Mackey
*Assistant Examiner*—Kaitlin S Joerger
(74) *Attorney, Agent, or Firm*—Oblon, Spivak, McClelland, Maier & Neustadt, P.C.

(57) ABSTRACT

A sheet storage device improved in terms of its performance in aligning sheets discharged from an image forming apparatus. In the sheet storage device, a plate-like shock absorber is superimposed on a surface of a fence member forming an end fence, and a lower end portion of the shock absorber is fixed to the fence member, with an intermediate portion thereof being curved so as to be convex and an upper end portion thereof being movably engaged with an engagement portion formed at an upper end of the fence member. In the intermediate portion, a spacer is provided between the fence member and the shock absorber to form a gap between the shock absorber and the fence member at a position where the shock absorber is hit by the sheets.

10 Claims, 10 Drawing Sheets

SHEET STORAGE DEVICE FOR IMAGE FORMING APPARATUS

BACKGROUND OF THE INVENTION

1. Field of the Invention

The present invention relates to a sheet storage device for stacking sheets discharge from an outlet of an image forming apparatus in order or in a regular manner on a sheet discharge table.

2. Description of the Background Art

Conventionally, the following prior art techniques relating to a sheet discharge device of this type mentioned above are known:

(1) A construction having a fence member provided upright on a sheet discharge table and a shock absorber mounted on the discharged sheet receiving surface side of the fence member with a gap between the shock absorber member and the delivery sheet receiving surface. The upper end of the shock absorber is supported in a manner as to be vertically movable and the lower end is fixed to the fence member. This construction is disclosed, for example, in JP 11-217151. In this prior art technique, a plate-like shock absorber such as a sponge member is provided on the front side of the fence member (the upstream side with respect to the sheet transport direction). The lower end portion of the shock absorber is fixed to the fence member by adhesive or the like, the upper side thereof is curved into a concave shape, and the upper end portion is held with clearance by an engagement portion formed in the upper portion of the fence member. Therefore, a gap between the fence member and the shock absorber is formed. Since the upper end portion of the shock absorber is held with clearance by the engagement portion of the fence member, it can be vertically displaced. Thus, when discharged sheets are stacked on the discharge table and the upper end portion of the shock absorber is downwardly displaced, there is little reduction in the change of the amount of gap between the fence member and the shock absorber at the sheet colliding position, with the result that the impact at the time of sheet collision is absorbed.

(2) A technique for preventing a sheet from sneaking through a gap between the lower portion of the fence member and the upper surface of the sheet discharge table, in which a "leg" extends from the lower portion of the fence member and a groove is formed in the upper surface of the sheet discharge table, causing the lower portion of the fence member to cross the upper surface of the sheet discharge table.

In the prior art technique (1), the cushioning behavior caused when the discharged sheet collides with the fence member differs in accordance with the kind of sheet, image condition, environmental changes, and the like. In some cases, since the sheet collision energy is not absorbed, and the sheet is returned to the sheet discharging outlet. Further, depending on the environmental condition and due to the temperature dependence of the shock absorber, the elasticity of the shock absorber may be changed. When the upper end portion of the shock absorber is held with clearance by the engagement portion formed in the upper portion of the fence member, the collision energy cannot be absorbed by the shock absorber alone. Thus, after the sheet collides with the fence member, the rebound is rather large. As the result, it sometimes impossible to stack the sheets in order or in a regular manner on the sheet discharge table.

In the prior art technique (2), when the fence member is positioned as it is at the sheet receiving position, it causes an obstacle at the time of removing the sheets stacked on the sheet discharge table. Thus, a construction is proposed in which the fence member is supported on the main body portion of a sheet storage device by a pivotable cantilever support arm and, when the discharged sheet is taken on out of the sheet discharge table, this support arm is rotated to cause the fence member to retract from the sheet removal area. In this construction, when the "leg" extends from the lower portion of the fence member as stated above, the following problem occurs. That is, when the support arm is rotated to cause the fence member and the shock absorber to integrally retract from the sheet removal area and to set them to the original positions again, there may be a danger of the operator such that his hand is caught between the above-mentioned "leg" and the upper surface portion of the sheet discharge table so as to suffer injury. This might be avoided by providing a gap between the lower portion of the fence member and the upper surface of the sheet discharge table. That, however, would allow the sheet to sneak through the lower gap after the collision with the fence member.

Technologies relating to the present invention are also disclosed in, e.g., JP 8-20468 A.

SUMMARY OF THE INVENTION

It is an object of the present invention to provide a sheet storage device in which, when the leading edge of a sheet discharged from the outlet of an image forming apparatus collides with an end fence, the sheet is prevented from rebounding toward the outlet owing to an appropriate shaping of a shock absorber, so that an improvement in discharge sheet alignment performance is improved.

It is another object of the present invention to provide a sheet storage device in which, when a sheet having collided with an end fence is stacked on a sheet discharge table, the sheet is prevented from sneaking through the gap between the lower portion of the end fence and the upper surface of the sheet discharge table, and the operator's safety can be maintained.

In accordance with the present invention, there is provided a sheet storage device for stacking sheets discharged from an outlet of an image forming apparatus in order or in a regular manner on a sheet discharge table by using an end fence arranged upright above the sheet discharge table. The sheet storage device comprises a fence member forming the end fence, a plate-like shock absorber superimposed on an outlet side surface of the fence member, the shock absorber having a lower end portion fixed to the fence member, an intermediate portion curved so as to be convex on an outlet side, and an upper end portion movably engaged with an engagement portion formed at an upper end of the fence member, and a spacer provided between the fence member and the shock absorber in the intermediate portion to form a gap between the shock absorber and the fence member at a position where the shock absorber is hit by the sheets.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

The present invention will now be described in detail with reference to the drawings.

Figure 1:
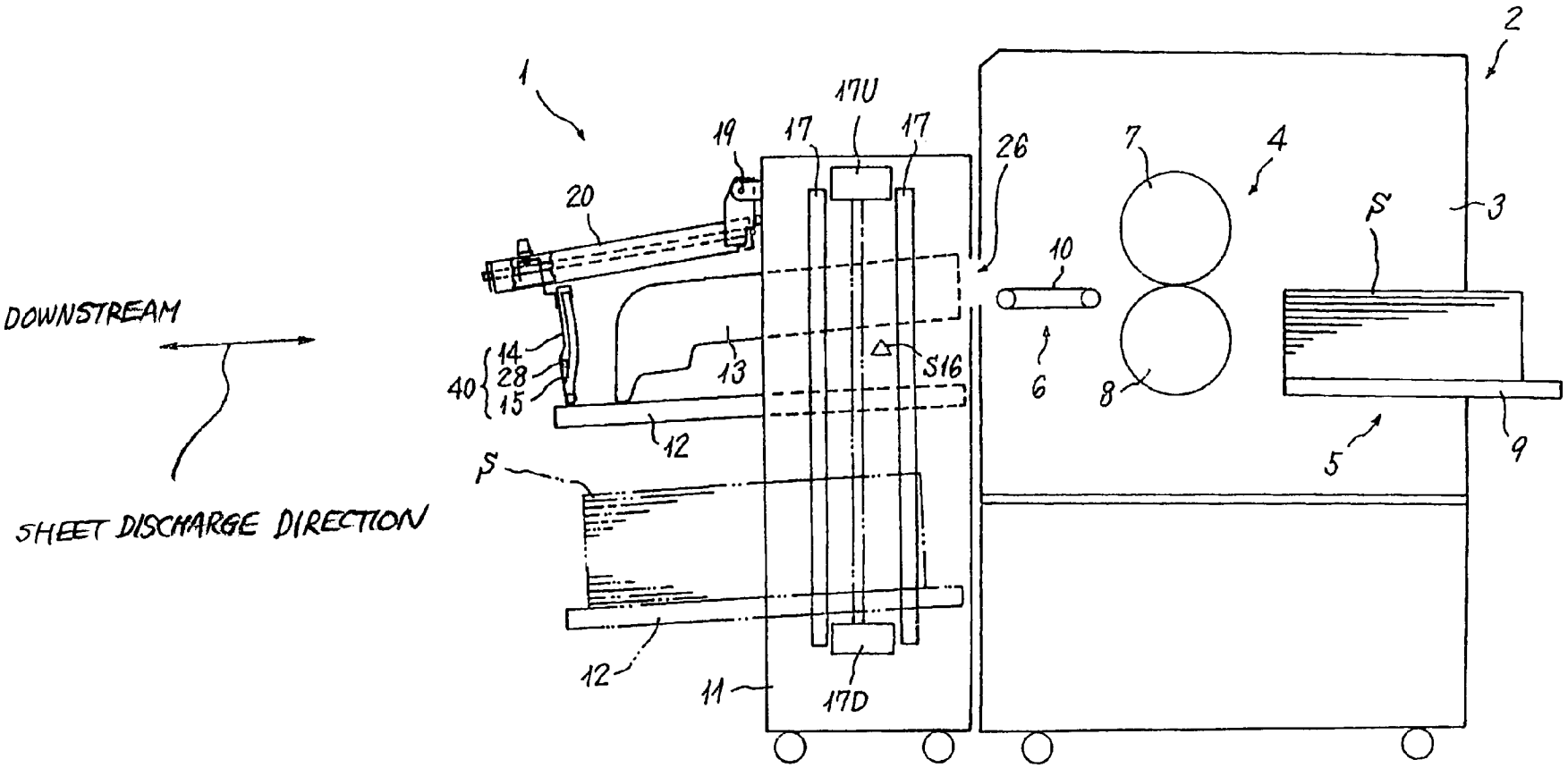
FIG. 1 is a front view schematically showing the general construction of a stencil printer and a sheet storage device in accordance with an embodiment of the present invention.
Figure 2:
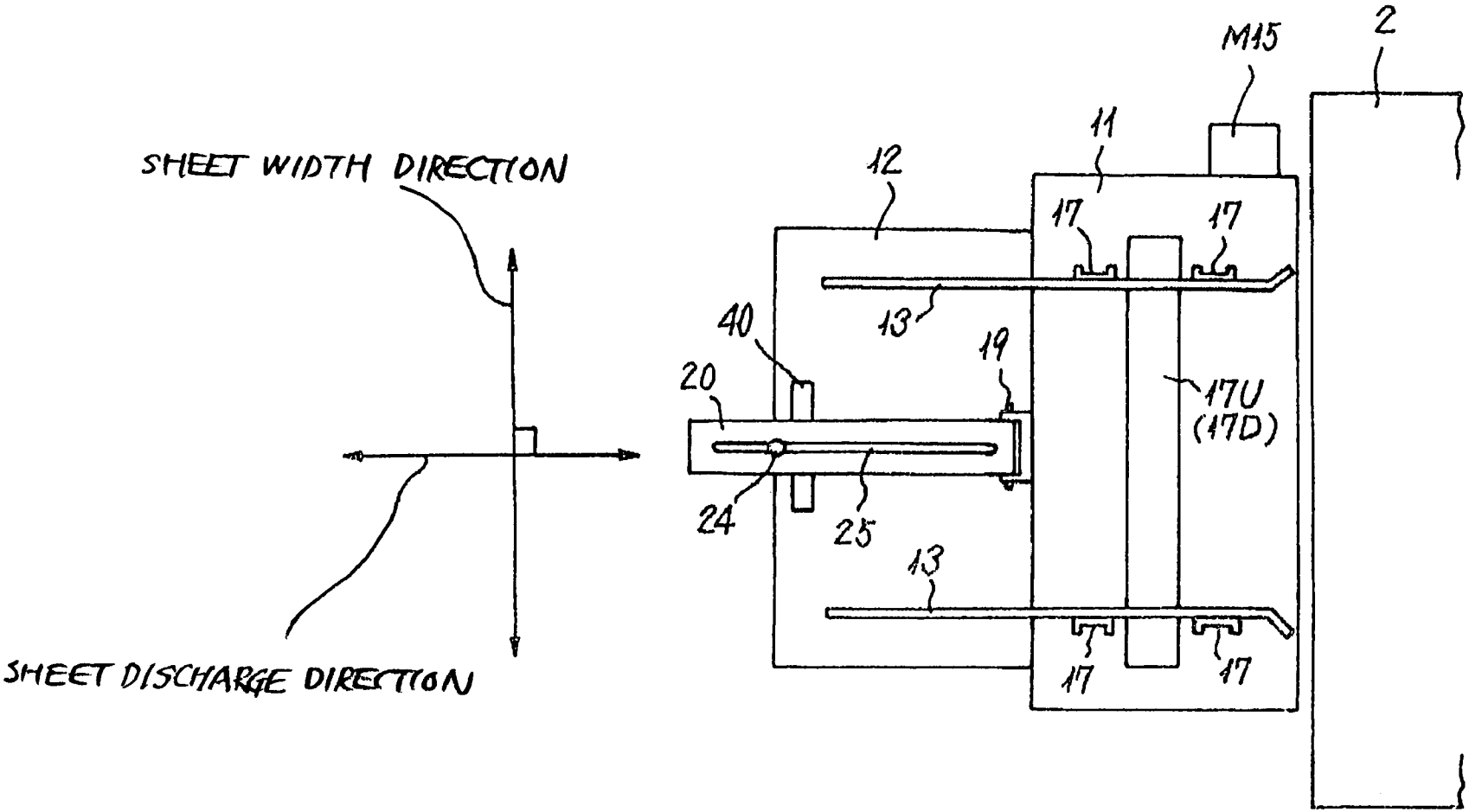
FIG. 2 is a plan view of the sheet storage device.
Figure 3:
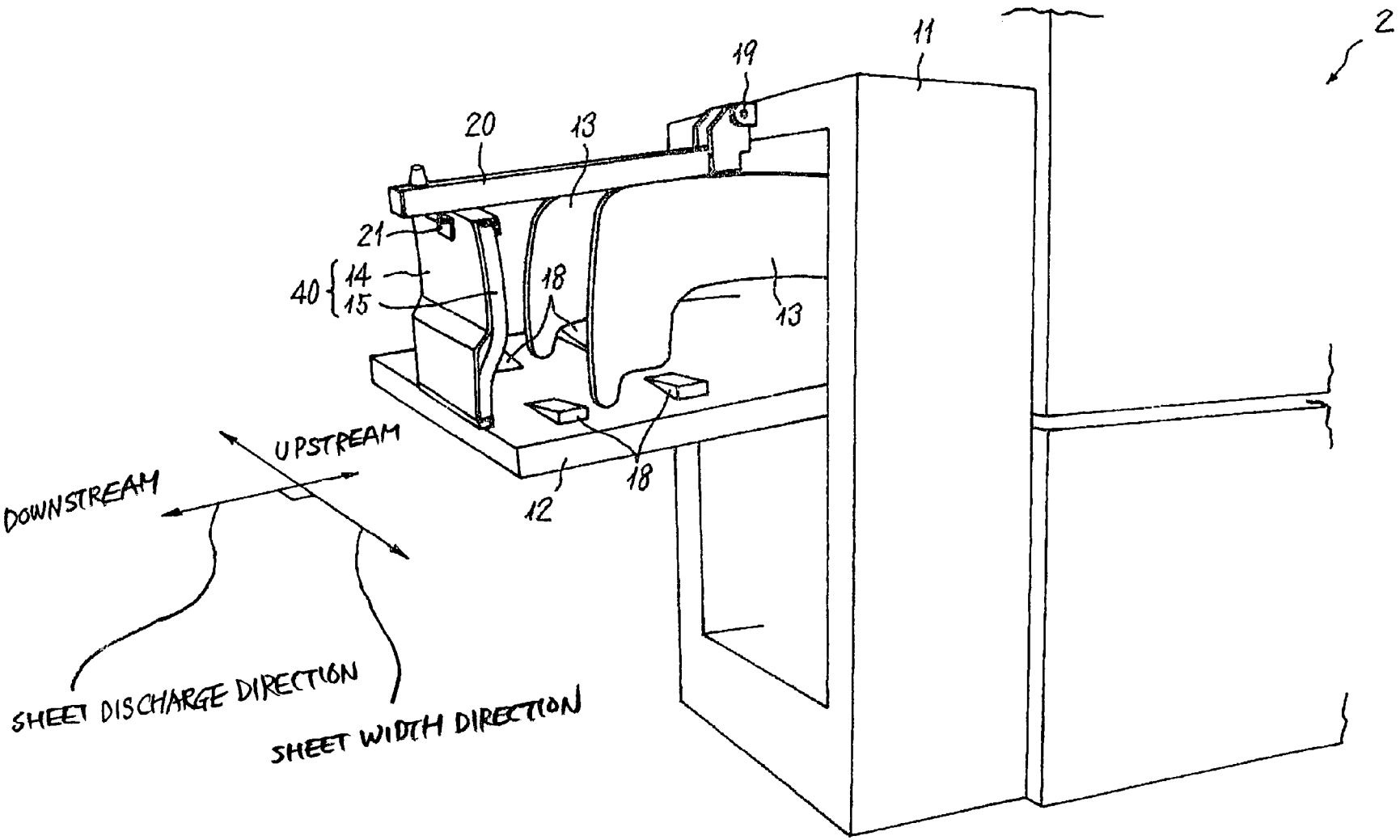
FIG. 3 is an outward perspective view of the sheet storage device.

FIGS. 1 through 3 show the construction of a stencil printer 2 as an image forming apparatus and a sheet storage device 1 in accordance with an embodiment of the present invention.

The stencil printer 2 comprises a casing 3, a printing section 4 provided substantially at the center of the casing 3, and a sheet feeding section 5 provided on the right-hand side of the casing 3 and a sheet discharge section 6 provided on the left-hand side of the casing 3. The printing section 4 has a print drum 7 rotatable with a perforated stencil or master wrapped therearound, and a press roller 8 which rotates in synchronism with the print drum 7 and brings a sheet S into press contact with the print drum 7. The sheet feeding section 5 has a sheet feeding tray 9 on which sheets S are stacked together, and a sheet feeding mechanism (not shown) for feeding sheets S from the sheet feeding tray 9 to the printing section 4. The sheet discharge section 6 has an endless belt 10 as a sheet transport member 10 which discharges sheets S from the stencil printer 2 to the exterior.

Inside the casing 3 of the stencil printer 2, there are provided a master making section (not shown) for making a master, and a master discharging section (not shown) for separating the used master from the outer periphery of the print drum 7. The stencil printer 2 performs printing in the printing section 4 on the sheets S fed from the sheet feeding section 5 and discharges the sheets S from the printing section 4 to the exterior of the casing 3 by the sheet discharging section 6.

As shown in FIG. 1, a casing 11 of the sheet storage device 1 is provided on the downstream side of the sheet transport member 10, that is, on the left-hand side of the sheet transport member 10. The casing 11 is equipped with a means for aligning the sheets S discharged from an outlet 26 of the stencil printer which is formed on the downstream side of the sheet transport member 10. The casing 11 is also equipped with an upright end fence 40 serving as a means for stacking the sheets in order or in a regular manner on a sheet discharge table 12 and extending in a vertical direction perpendicular to the sheet discharge direction.

Next, the sheet storage device 1 is provided with the casing 11 as a main body, the sheet discharge table 12, a pair of guiding and stacking side fences 13 and 17, respectively and the end fence 40. The end fence 40 includes a fence member 14, a shock absorber 15 provided on the fence member 14, and other additional members. The shock absorber 15 comprises a sponge member or a sponge-like soft elastic material. The sheet discharge table 12 is supported by a vertical movement mechanism (not shown) provided inside the casing 11 and is vertically moved by a drive motor M15 serving as a sheet discharge table raising/lowering means which is mounted to a side portion of the casing 11, as shown in FIG. 2.

The vertical movement mechanism for the sheet discharge table 12 is disclosed, for example, in JP 2002-226122. The raising/lowering mechanism is equipped with an upper surface detection sensor S16 for detecting the upper surface position of the sheets S stacked on the sheet discharge table 12. When the sensor S16 detects the upper surface portion of the sheets S, the sheet discharge table 12 is lowered by a predetermined amount.

As shown in FIG. 3, fixed wedge-shaped members 18 in U-shape for maintaining the stacked sheets S is provided on the forward end side of the sheet discharge table 12 in sheet discharge direction.

The side fences 13 and 17 serving as a means for guiding the sheets S onto the sheet discharge table 12 in the direction of sheet width. The guiding side fences 13 guide the sheets discharged from the stencil printer 2 to the sheet discharge table 12, while the stacking side fences 17 guides the sheets S to be stacked onto the sheet discharge table 12.

The pair of guiding side fences 13 facing each other in the direction of the sheet width above the sheet discharge table 12 (the direction perpendicular to the plane of FIG. 1) are provided. The guiding side fences 13 are fixed on the inner side of the stacking side fences 17, that is, four column-like vertically elongated stacking side fences 17 facing each other in the direction of the sheet width. The four stacking side fences 17 extend in the vertical direction with respect to the sheet discharge table 12 to cover the vertical movement stroke of the sheet discharge table 12. The four stacking side fences 17 are fixed to upper and lower drive portions 17U and 17D which constitute side fence driving portions installed in upper and lower portions as driving means allowing adjustment in the sheet width direction. The stacking side fences 17 are driven in such a manner as to reduce or enlarge the facing distance in the direction of the sheet width, using the sheet center as a reference.

For example, the upper and lower drive portions 17U and 17D constituting the side fence driving portions are moved in pairs in the direction of the sheet width by a pinion/rack mechanism. The pinion is disposed at the center in the direction of the sheet width and connected through belt/pulleys to an adjustment handle provided outside the casing. The sheet width can be adjusted by a single handle provided outside the casing 11 through a shaft and pulleys (not shown).

As shown in FIGS. 1 through 4, the fence member 14 is positioned above the stacking surface (upper surface) of the sheet discharge table 12 and is fixed to a fence support member (movement mechanism) 20 pivotably supported by the casing 11 through a fulcrum shaft 19.

Figure 4:
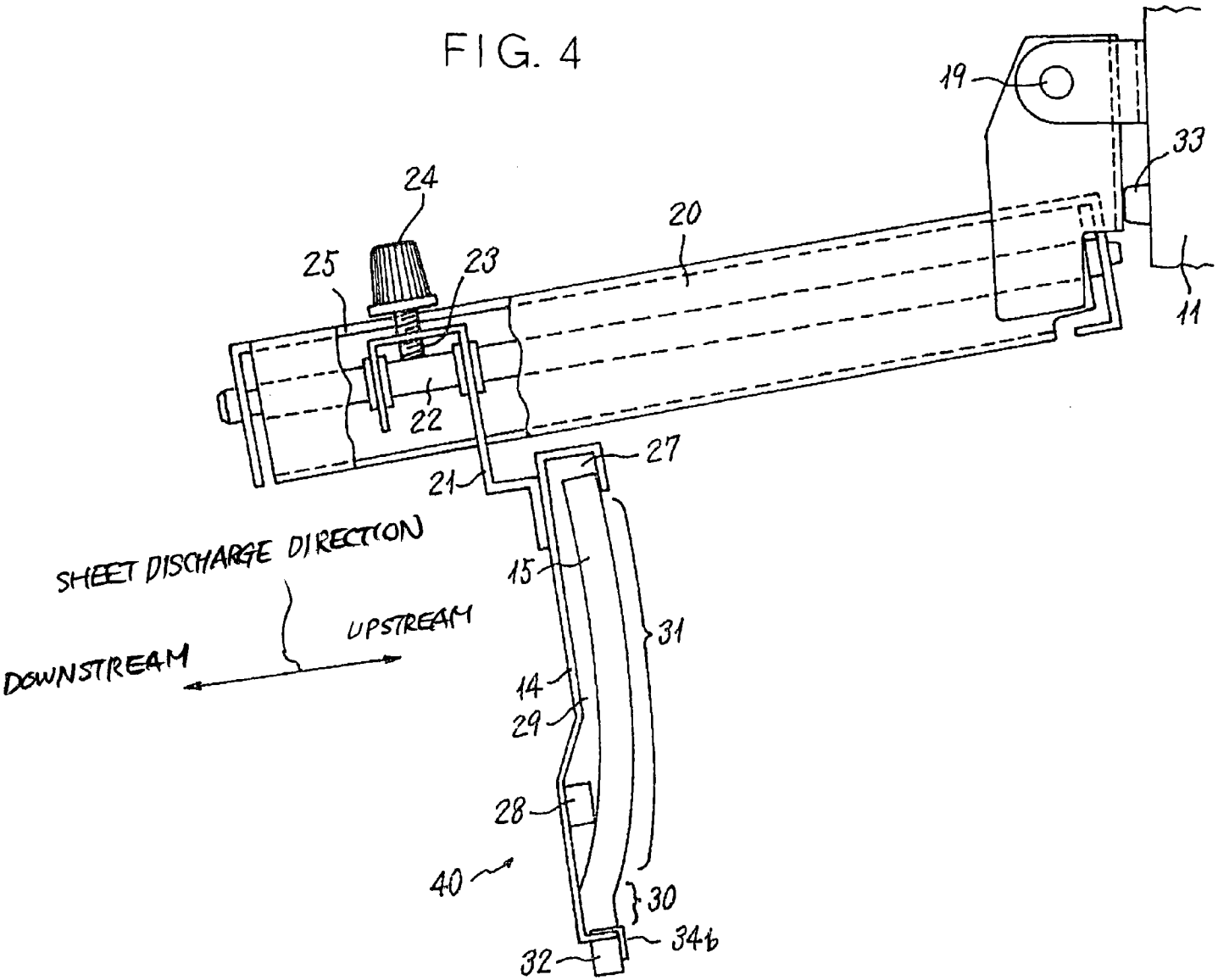
FIG. 4 is a side view of an end fence and a fence member support member of the sheet storage device.

This fence support member 20 is provided substantially at the center of the fence member 14 in the direction of the sheet width As shown in FIG. 4, the lower portion of a support plates 21 is fixed to the center of the upper portion of the fence member 14. The upper portion of this support plate 21 is bent into a U-shape, and is slidably engaged with a guide bar 22 which is supported inside the fence support member 20 in the direction of the sheet width.

Thus, the fence member 14 is slidable in the sheet discharge direction and can be adjusted according to the length of the sheet S in the sheet discharge direction. When the position of the fence member 14 is determined by the sheet length of the sheet S in the sheet discharge direction, a knob 24 integrated with a screw 23 passed through and threadedly engaged with the support plate 21 is manually turned to integrate the guide bar 22 with the support plate 21, so that the position of the fence member 14 is determined.

Figure 5:
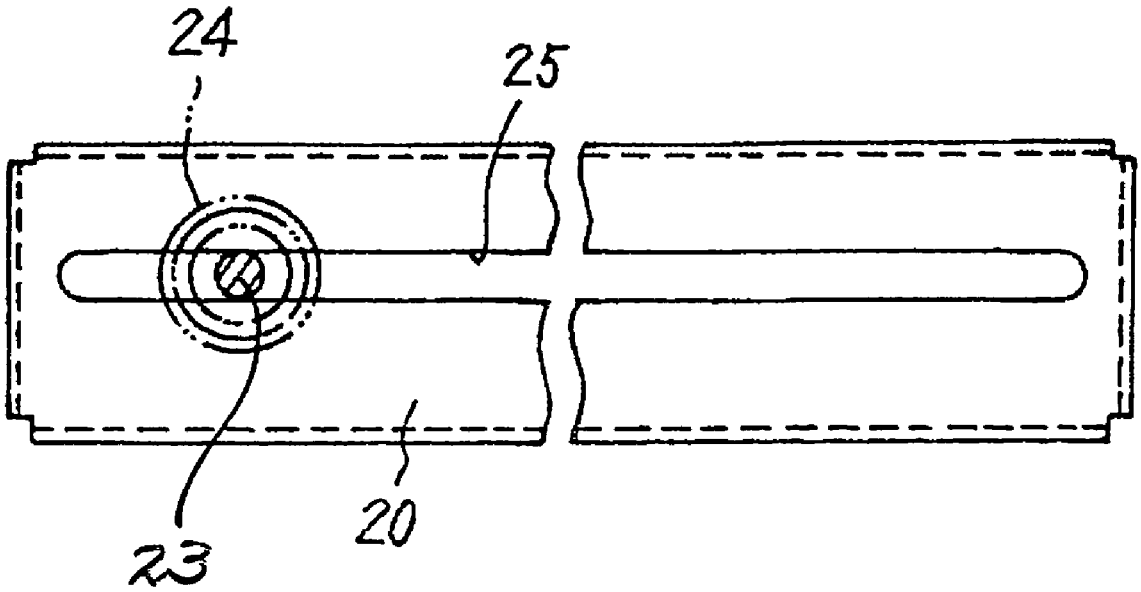
FIG. 5 is a plan view of the fence member support member.

When the knob 24 is loosened to change position of the fence member 14, the integration of the guide bar 22 and the support member 21 is released so that the fence member 14 can be moved along the guide bar 22. The knob 24 is exposed to the outside from the upper portion of the fence support member 20 so as to allow turning operation. As also shown in FIGS. 4 and 5, since the screw 23 integral with the knob 24 is positioned in a groove 25 formed in the fence support member 20, the screw 23 can be moved in the sheet discharge direction.

Figure 6:
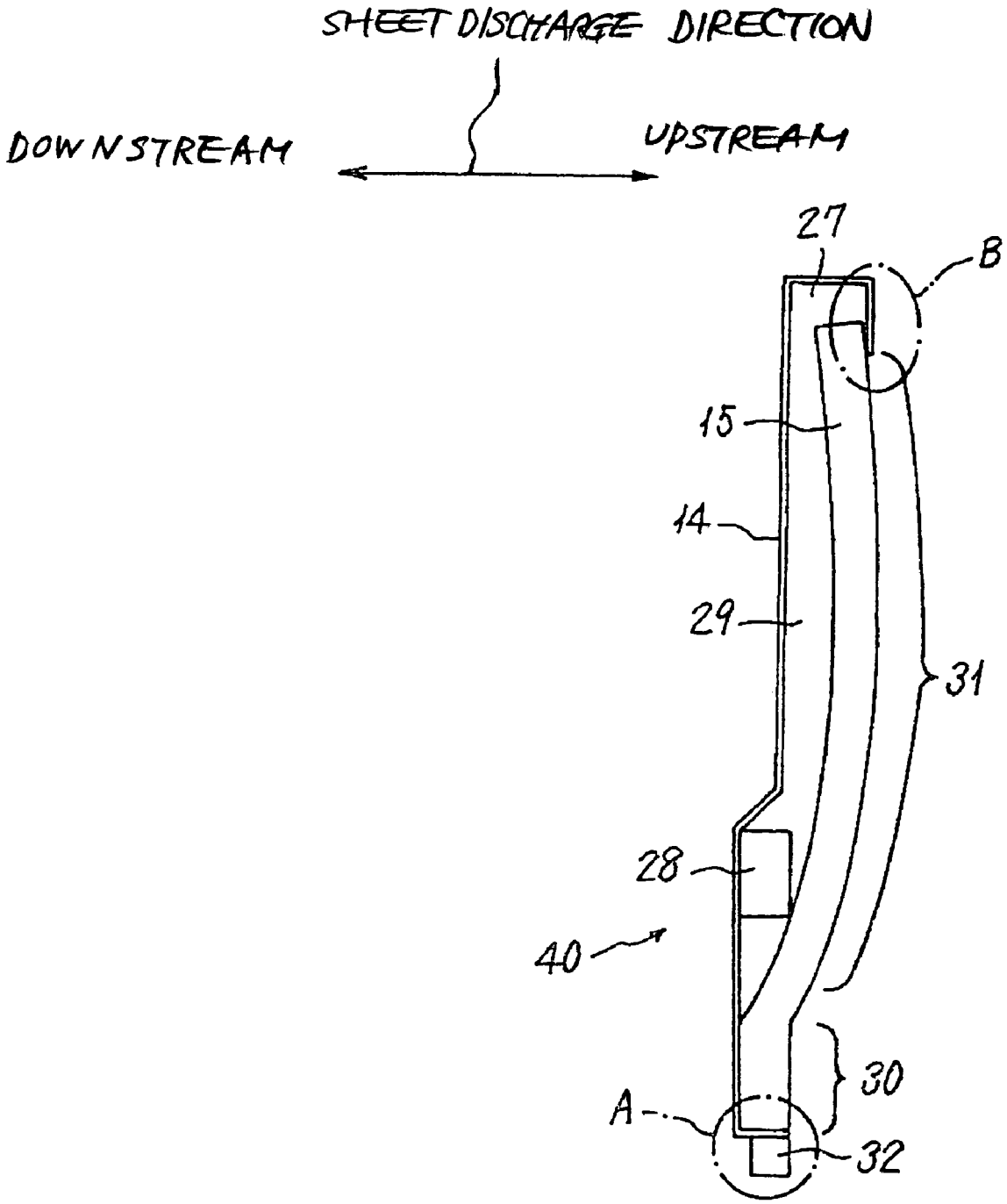
FIG. 6 is a side view of the end fence.

As shown in FIGS. 3, 4 and 6, the shock absorber 15 having a plate-like shape is superimposed on the surface of the fence member 14 on the side of the outlet 26 or on the right-hand side of the fence member 14. The lower end portion of the shock absorber 15, that is, the portion thereof in close contact with the fence member 14, is fixed to the fence member 14. The intermediate portion of the shock absorber 15 is curved so as to be convex on the side of the outlet 26. The upper end portion of the curved portion is movably engaged with an engagement portion 27 formed at the upper end of the fence member 14 and bent into a U-shape. Further, a spacer 28 is provided between the fence member 14 and the shock absorber 15 and a gap or space 29 is formed at an intermediate position between the spacer 28 and an engagement portion 27 and also between the shock absorber 15 and the fence member 14. The embodiment is characterized by the provision of the spacer 28 between the fence member 14 and the shock absorber 15 in order to form the gap 29 at the position where the leading edge of the discharged sheet S hits the shock absorber 15.

As mentioned above, since, the gap 29 is formed between the fence member 14 and the shock absorber 15, the spacer 28 is provided at the position where the discharged sheet S hits the shock absorber 15 and the upper portion of the shock absorber 15 constitutes the free end side of a cantilever support structure, the shock absorber 15 can be displaced downstream in the sheet discharge direction. Further, due to the impact absorbing property of the shock absorber 15, the colliding force of the sheet S is absorbed and the discharged sheets S are stacked in order or in a regular manner on the sheet discharge table 12.

The fence member 14 is formed of a metal plate or a resin plate, and the shock absorber 15 is formed of a shock absorbing material such as a sponge sheet which can absorb the colliding force generated when the leading edge of the sheet collides with the shock absorber 15.

In FIG. 6, the lower portion of the shock absorber 15 is firmly glued to the lower portion of the fence member 14 by means of adhesive or the like. The shock absorber 15 is formed so as to be convex on the upstream side in the sheet discharge direction, and its upper end portion is engaged with clearance with the engagement portion 27 formed by being bent into a U-shaped above the fence member 14, with the shock absorber 15 being capable of being displaced downstream in the sheet discharge direction using its lower end as a fulcrum.

The region of the lower end portion of the shock absorber 15 corresponding to the stationary portion in close contact with the fence member 14 and on the outlet 26 side (the right-hand side surface) constitutes a sheet stacking portion 30. Due to the convex or rounded configuration of the shock absorber 15, the sheet stacking portion 30 is provided on the downstream side in the sheet discharge direction of a sheet collision portion 31. The sheet collision portion 31 corresponds to the region between the engagement portion 27 and the spacer portion 28 where the discharged sheet S hits the shock absorber 15.

When the discharged sheet S hits the shock absorber 15 and makes a free fall, the sheet S flows down along the surface of the shock absorber 15, with the result that the sheet S is stacked in order or in a regular manner on the downstream side in the sheet discharge direction.

The portion of the shock absorber 15 positioned from the position where the sheet S hits the shock absorber 15 to the region where the sheets S are stacked is formed in a rounded configuration convex on the upstream side in the sheet discharge direction and the surface portion thereof in the region where the sheets are stacked is formed as a straight vertical surface. Therefore, the discharged sheet S falls along the surface of the shock absorber and is stacked on the sheet discharge table 12. Since the surface portion of the shock absorber 15 in the region where the sheets S are stacked is on the downstream side in the discharge direction of the surface position of the shock absorber 15 hit by the discharged sheet S, the sheets S always hit the fence member 14 side while being stacked.

The sheet collision portion 31 as the surface portion of the shock absorber 15 hit by the sheets S, that is, the portion extending down to the region where the sheets S are stacked on the sheet discharge table 12, is formed in a rounded configuration, while the surface portion of the shock absorber 15 corresponding to the region where the sheets S are stacked on the sheet discharge table 12 is formed as a flat vertical surface. Therefore, the discharge sheets S fall along the rounded surface, and can be stacked vertically in order or in a regular manner in conformity with the sheet stacking portion consisting of the flat vertical surface.

As described above, the fence member 14 retaining the shock absorber 15 is fixed to the fence support member (movement mechanism) 20 which is pivotably supported to the casing 11 through the fulcrum shaft 19.

As shown in FIG. 4, when the fence member 14 is to be positioned upright so as to be capable of receiving the sheets S on the sheet discharge table 12, the fence support member 20 is retained in position by a stopper member 33 provided on the casing 11, with a part of the fence support member 20 abutting the stopper member 33 by rotational moment.

When printing has been performed for a predetermined number of sheets S, and the sheets S stacked on the sheet discharge table 12 are taken out thereof, the free end portion of the fence support member 20 is raised, whereby the fence support member 20 is pivoted using the fulcrum shaft 19 as a fulcrum. Then, as shown in FIG. 9, since the fence support member 20 is raised until it abuts the upper portion of the casing 11, the sheets S stacked on the discharge table 12 can be easily taken out of the sheet discharge table 12.

Figure 9:
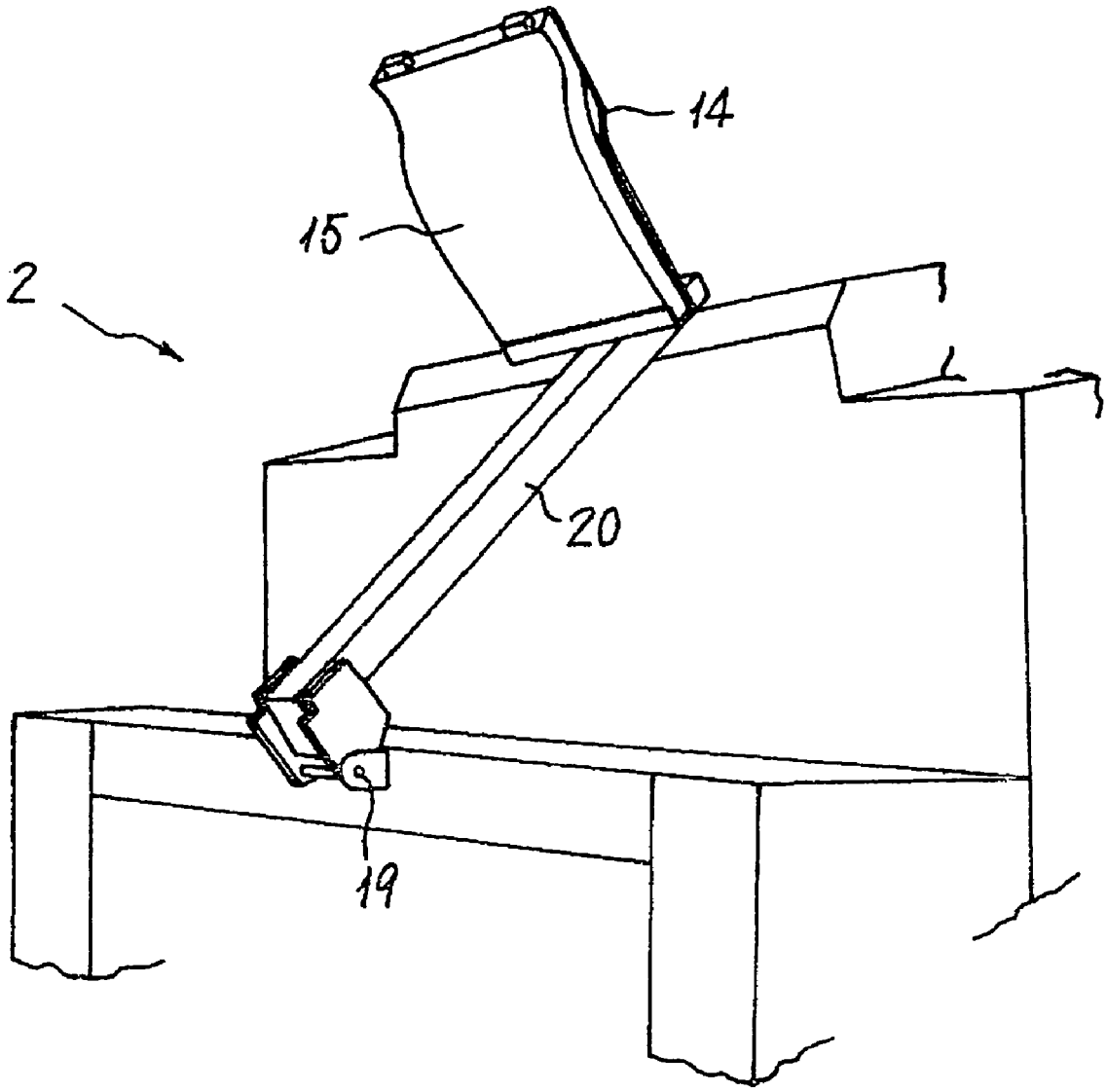
FIG. 9 is a perspective view showing the end fence as retracted through rotation from the sheet discharge table.

After the sheets S have been taken out of the sheet discharge table 12, the fence member 20 is pivoted from the position shown in FIG. 9 to be restored to the sheet receiving state as shown in FIGS. 1, 3 and 4. Then, there may be a danger of the operator having his hand or finger caught between the lower portion of the fence member 14 and the sheet discharge table 12.

In accordance with the embodiment, as shown in FIGS. 4, 6, and 7, and FIG. 8 which is an enlarged view of portion A of FIG. 6, rectangular soft members 32 is provided at both ends of the lower portion of the fence member 14 in a manner as to be continuous to the lower portion in the extension of the surface of the shock absorber 15 on the upstream side in the sheet discharge direction. The soft members 32 are formed of a soft and elastic sponge-like material, with the result that there is no danger of the operator touching the lower portion of the fence member 14 when setting the fence member 14 to suffer injury.

In accordance with the embodiment, the soft members 32 are of a size capable of filling the gap between the discharge sheet table 12 and the fence member 14, thus eliminating the gap between the sheet discharge table 12 and the fence member 14.

The leading edges of the sheets S having hit the shock absorber 15 fall while rubbing the surface portion of the shock absorber 15, and the sheets S are stacked on the sheet discharge table 12 without any resistance. Then, the sheets S are inclined to sneak through the gap under the fence member 14 because of their weight. However, due to the soft members 32 eliminating the gap between the fence member 14 and the sheet discharge table 12, the sheets S are prevented from sneaking away. Here, instead of providing the soft members 32 at either end of the lower portion of the fence member 14 as shown in the figures, it is also possible to provide the soft member in a manner as to extend over the entire lower portion of the fence member 14. Alternatively, it is also possible to provide a single soft member at the center of the lower portion.

As shown in FIGS. 4, 6, 7 and 8, a soft thin plate member 34 is provided in the extension of the surface portion of the shock absorber 15 corresponding to the region where the sheets are stacked on the sheet discharge table 12. This soft thin plate member 34 consists of a thin plate bent into an L-shape, one surface 34*a* of which is superimposed on the surface bent into an L-shape at the lower end of the fence member 14 and fixed thereto, and the other surface 34*b* of which extends along the surfaces of the soft members 32.

Figure 7:
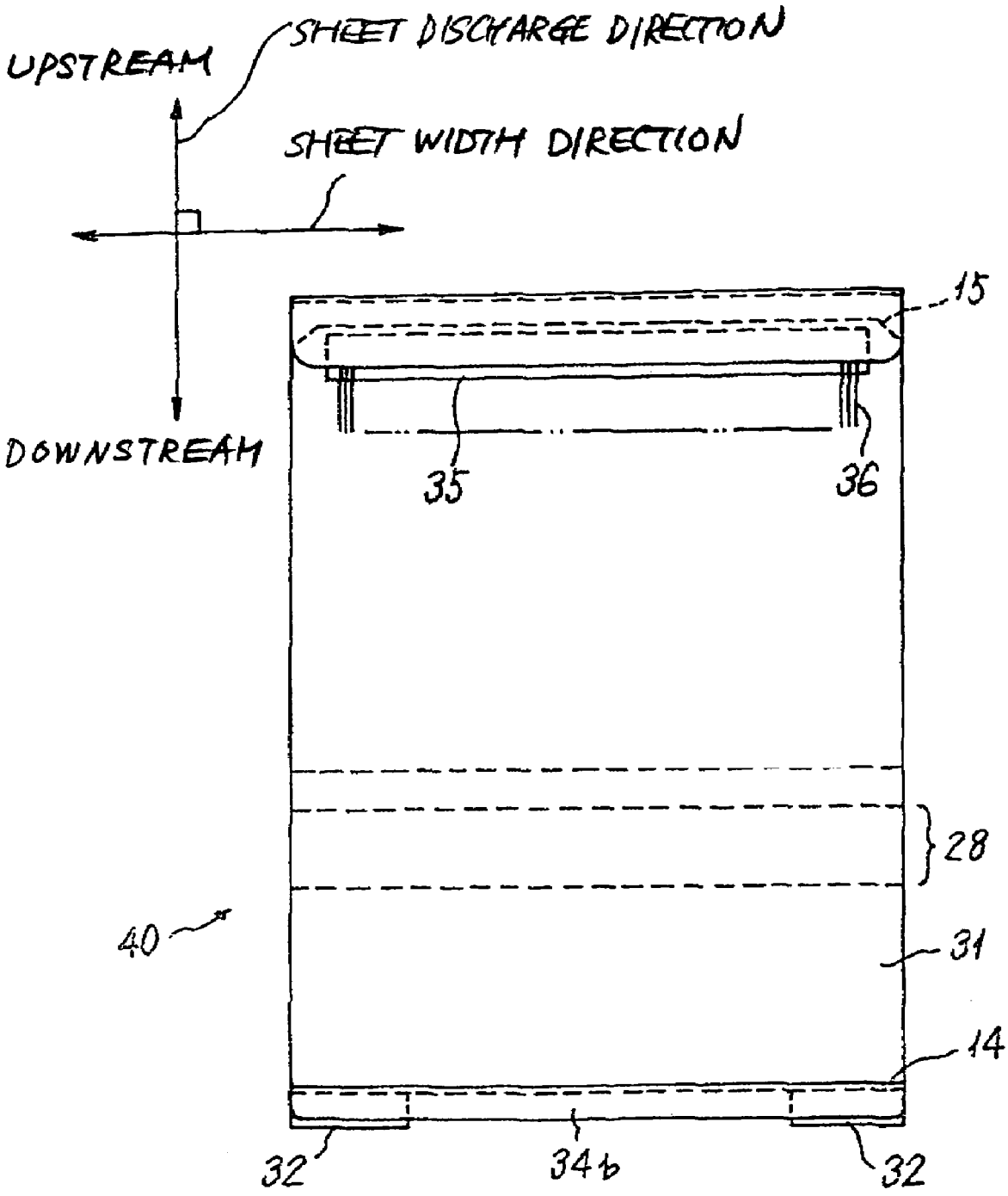
FIG. 7 is a front view of the end fence.
Figure 8:
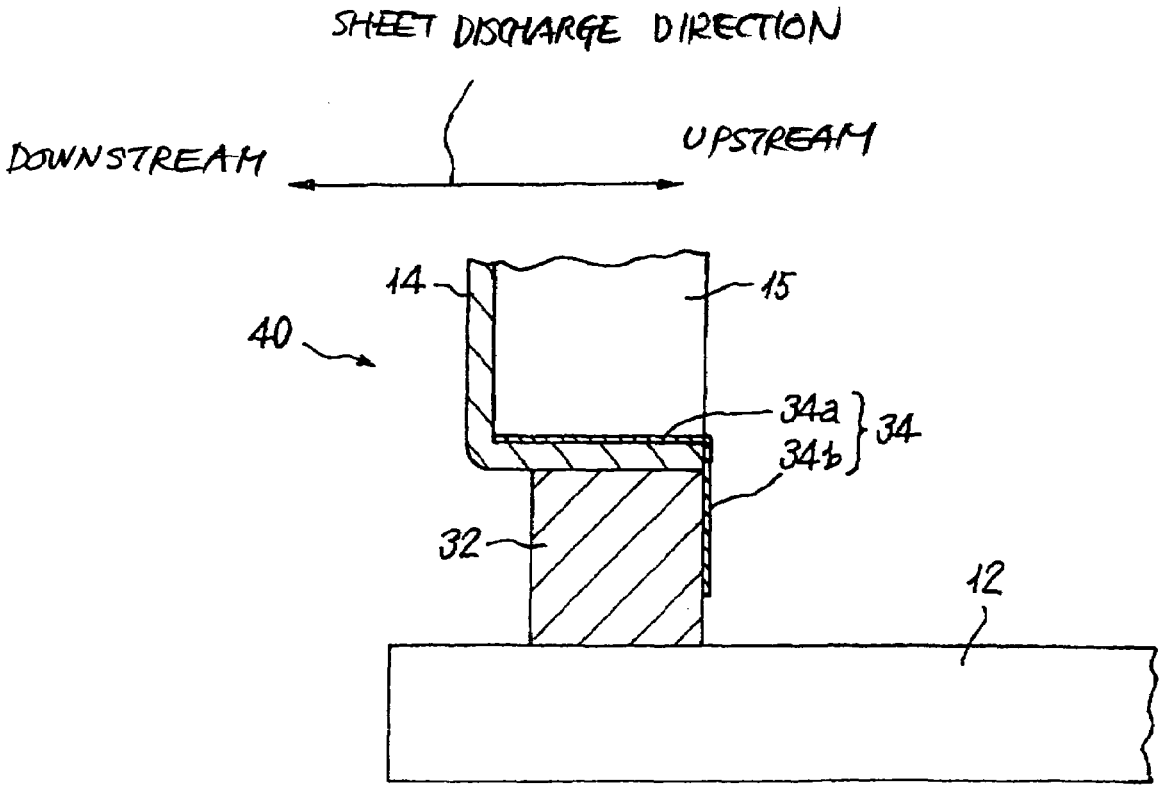
FIG. 8 is a partial side sectional view showing a lower portion of the end fence.

As shown in FIG. 7, the other surface 34*b* of the soft thin plate member 34 is provided in the surface extension of the shock absorber 15 positioned in the lower portion of the fence member 14. Thus, the leading edges of the sheets S having hit the shock absorber 15 fall while sliding on the surface of the shock absorber 15 with the other surface 34*b* of the soft thin plate member 34 serving as a guide surface, and the sheets S are stacked in order or in a regular manner on the sheet discharge table 12 without involving any resistance.

Figure 10:
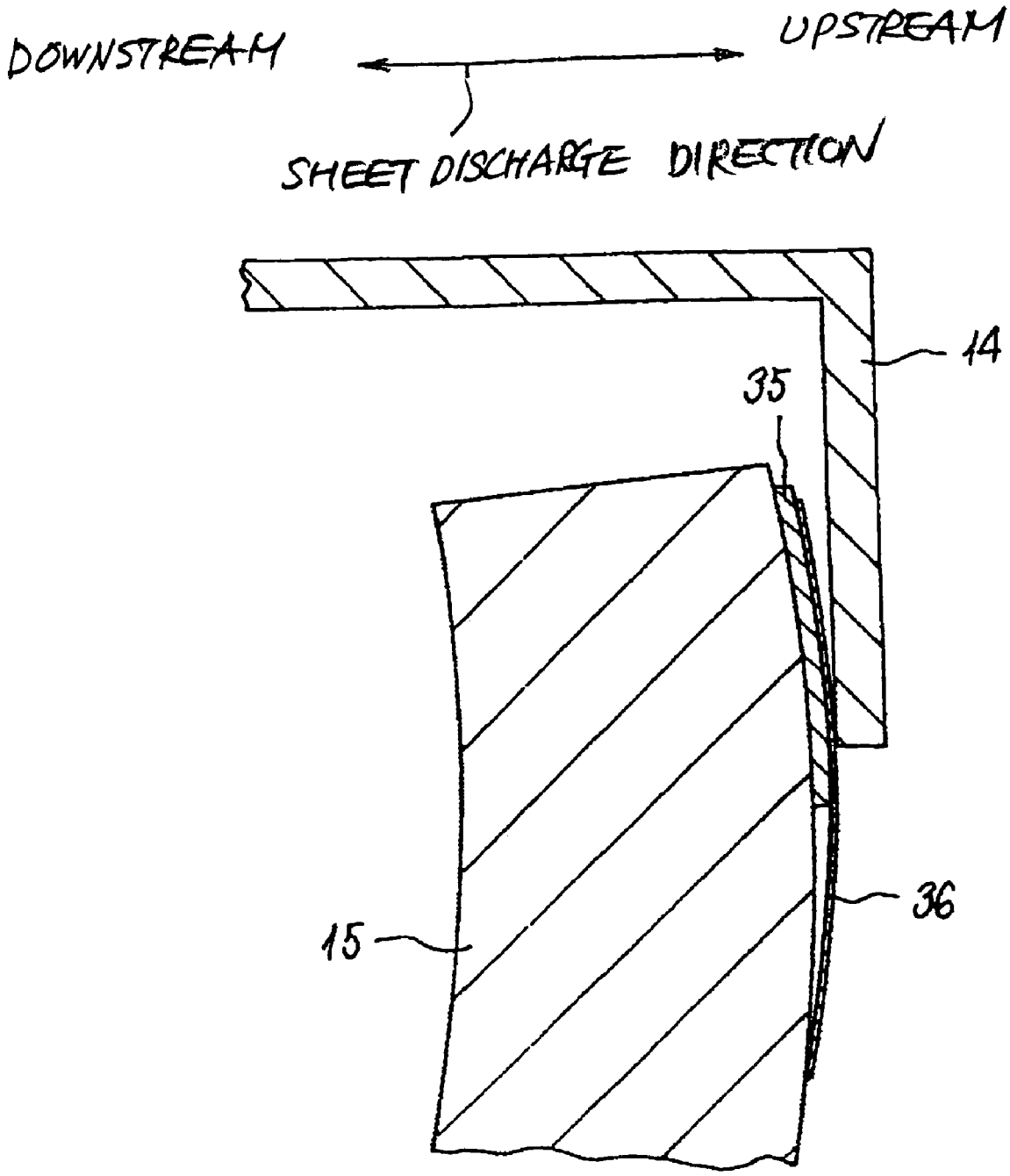
FIG. 10 is a partial side sectional view showing an upper portion of the end fence.

When the sheets S are stacked on the sheet discharge table 12, the shock absorber 15 may be charged with static electricity, with the result that smooth stacking of the sheets is hindered. In the embodiment, as shown in FIG. 7 and FIG. 10 which is an enlarged view of portion B of FIG. 6, a charge eliminating brush 36 is attached by means of a double-coated tape 35 to the surface portion positioned in the upper portion of the shock absorber 15 and coming into contact with the inner side of the bent portion of the fence member 14. The static electricity with which the shock absorber is charged is eliminated and the sheets S can be stacked on the sheet discharge table 12 smoothly.

Next, the discharging and stacking conditions will be described.

In accordance with the width and length of the sheets S discharged from the stencil printer 2, a position adjustment is effected on the guiding side fences 13 and the end fence 40, that is, the structure including the fence member 14 and the shock absorber 15. The sheets S discharged from the stencil printer 2 are guided to the sheet discharged table 12 by the guiding side fences 13, and the leading edges of the sheets S hit the shock absorber 15. Therefore, the sheets S make a free fall while being regulated by the stacking side fences 17 through the guiding side fences 13 and is stacked on the sheet discharge table 12.

When the height of the sheets S stacked on the sheet discharge table 12 has become greater than the height of the upper surface detection sensors S16 provided at the front and rear of the casing 11 and a predetermined period of time has elapsed, the DC motor M15 operates for a predetermined period of time to lower the sheet delivery table 12 by an amount corresponding to the stacking height and the sheet discharge table 12 descends and stops. This operation is repeated, making it possible to effect discharging and stacking of a great amount of sheets. When the sheet discharge table 12 has reached the lowermost limit and a lower limit sensor (not shown) detects the sheet discharge table 12, the printing stops.

As mentioned above, the advantages of the present invention are as follows:

(1) The spacer for forming a gasp or space is provided between the fence member and the shock absorber and the spacer is positioned between the fence member and the shock absorber at the position where the discharged sheets hit the shock absorber. Therefore, due to the shock absorbing property of the shock absorber and the ability of the upper portion of the shock absorber to be displaced downstream in the sheet discharge direction, it is possible to absorb the colliding force of the sheets in correspondence with various conditions, such as the kind of sheet and the environment so that the sheets S can be stacked in order or in a regular manner on the sheet discharge table.

(2) When the discharged sheets hit the shock absorber and make a free fall, they flow down along the surface of the shock absorber, so that the sheets can be stacked on the sheet discharge table in order of in a regular manner on the downstream side in the sheet discharge direction.

(3) The discharged sheets fall along the surface of the rounded configuration, and are aligned by the sheet stacking portion formed by a flat vertical surface, so that the sheets can be stacked vertically and in order or in a regular manner on the sheet discharge table.

(4) At the time of setting the fence member, there is no danger of the operator touching the lower portion of the fence member to suffer injury.

(5) The gap between the sheet discharge table and the fence member is filled by the soft members, with the result that the discharged sheets are prevented from sneaking under the fence member so as to stack the sheets in order or in a regular manner on the sheet discharge table.

(6) The soft thin plate member is provided in the extension of the surface of the portion of the shock absorber corresponding to the lower portion of the fence member. Thus, when the leading edges of the sheets having hit the shock absorber fall while sliding on the surface of the shock absorber, the sheet can be stacked in order or in a regular manner on the sheet discharge table without involving any resistance.

Various modifications will become possible for those skilled in the art after receiving the teachings of the present disclosure without departing from the scope thereof.

What is claimed is:

1. A sheet storage device for stacking sheets discharged from an outlet of an image forming apparatus in order or in a regular manner on a sheet discharge table by using an end fence arranged upright above the sheet discharge table, the sheet storage device comprising:

a fence member forming the end fence;

a plate shaped shock absorber superimposed on an outlet side surface of the fence member, the shock absorber having a lower end portion fixed to the fence member, an intermediate portion curved so as to be convex on an outlet side, and an upper end portion engaged to be movable in at least a horizontal and vertical direction with an engagement portion formed at an upper end of the fence member;

a spacer provided between the fence member and the shock absorber in the intermediate portion to form a gap between the shock absorber and the fence member at a position where the shock absorber is hit by the sheets; and a soft member provided in a lower portion of the fence member, wherein the soft member has a size large enough to fill a gap between the sheet discharge table and the fence member.

2. A sheet storage device as claimed in claim 1, wherein a surface portion of the shock absorber corresponding to a region where the sheets are stacked on the sheet discharge table is positioned on a downstream side with respect to a sheet discharge direction of a surface portion of the shock absorber hit by the discharged sheets.

3. A sheet storage device as claimed in claim 2, wherein at least a portion of the shock absorber from the surface portion thereof hit by the sheets up to the region where the sheets are stacked on the sheet discharge table has a rounded configuration, and wherein the surface portion of the shock absorber corresponding to the sheet stacking portion is formed by a flat vertical surface.

4. A sheet storage device as claimed in claim 2, further comprising a soft thin plate member provided in an extension of the surface portion of the shock absorber corresponding to the region where the sheets are stacked on the sheet discharge table.

5. A sheet storage device as claimed in claim 1, wherein at least a portion of the shock absorber from a surface portion thereof hit by the sheets up to a region where the sheets are stacked on the sheet discharge table has a rounded configuration, and wherein the surface portion of the shock absorber corresponding to the sheet stacking portion is formed by a flat vertical surface.

6. A sheet storage device as claimed in claim 5, further comprising a soft thin plate member provided in an extension of the surface portion of the shock absorber corresponding to the region where the sheets are stacked on the sheet discharge table.

7. A sheet storage device as claimed in claim 1, wherein a soft thin plate member is provided in an extension of a surface portion of the shock absorber corresponding to a region where the sheets are stacked on the sheet discharge table.

8. A sheet storage device for stacking sheets discharged from an outlet of an image forming apparatus in order or in a regular manner on a sheet discharge table by using an end fence arranged upright above the sheet discharge table, the sheet storage device comprising:

a fence member forming the end fence;

a plate shaped shock absorber superimposed on an outlet side surface of the fence member, the shock absorber having a lower end portion fixed to the fence member, an intermediate portion curved so as to be convex on an outlet side, and an upper end portion movably engaged with an engagement portion formed at an upper end of the fence member, a surface portion of the shock absorber corresponding to a region where the sheets are stacked on the sheet discharge table is positioned on a downstream side with respect to a sheet discharge direction of a surface portion of the shock absorber hit by the discharged sheets;

a spacer provided between the fence member and the shock absorber in the intermediate portion to form a gap between the shock absorber and the fence member at a position where the shock absorber is hit by the sheets; and a soft member provided in a lower portion of the fence member;

wherein the soft member has a size large enough to fill a gap between the discharge sheet table and the fence member.

9. A sheet storage device for stacking sheets discharged from an outlet of an image forming apparatus in order or in a regular manner on a sheet discharge table by using an end fence arranged upright above the sheet discharge table, the sheet storage device comprising:

a fence member forming the end fence;

a plate shaped shock absorber superimposed on an outlet side surface of the fence member, the shock absorber having a lower end portion fixed to the fence member, an intermediate portion curved so as to be convex on an outlet side, and an upper end portion movably engaged with an engagement portion formed at an upper end of the fence member, at least a portion of the shock absorber from a surface portion thereof hit by the sheets up to a region where the sheets are stacked on the sheet discharge table has a rounded configuration, and wherein the surface portion of the shock absorber corresponding to the sheet stacking portion is formed by a flat vertical surface;

a spacer provided between the fence member and the shock absorber and disposed in a gap between the shock absorber and the fence member at a position where the shock absorber is hit by the sheets; and a soft member provided in a lower portion of the fence member;

wherein the soft member has a size large enough to fill a gap between the sheet discharge table and the fence member.

10. A sheet storage device for stacking sheets discharged from an outlet of an image forming apparatus in order or in a regular manner on a sheet discharge table by using an end fence arranged upright above the sheet discharge table, the sheet storage device comprising:

a fence member forming the end fence;

a plate shaped shock absorber superimposed on an outlet side surface of the fence member, the shock absorber having a lower end portion fixed to the fence member, an intermediate portion curved so as to be convex on an outlet side, and an upper end portion movably engaged with an engagement portion formed at an upper end of the fence member;

a spacer provided between the fence member and the shock absorber and disposed in a gap between the shock absorber and the fence member at a position where the shock absorber is hit by the sheets; and a soft member provided in a lower portion of the fence member;

wherein the soft member has a size large enough to fill a gap between the sheet discharge table and the fence member.

* * * * *